United States Patent [19]

Meixner

[11] 4,230,935

[45] Oct. 28, 1980

[54] IMMERSION HEATER

[75] Inventor: Hans Meixner, Haar, Fed. Rep. of Germany

[73] Assignee: Siemens Aktiengesellschaft, Berlin & Munich, Fed. Rep. of Germany

[21] Appl. No.: 12,053

[22] Filed: Feb. 13, 1979

[30] Foreign Application Priority Data

Feb. 14, 1978 [DE] Fed. Rep. of Germany ..... 2806159

[51] Int. Cl.[3] ..... H05B 3/06

[52] U.S. Cl. ..... 219/523; 219/328; 219/441; 219/504; 219/530; 219/540; 219/541; 219/544; 338/22 R

[58] Field of Search ..... 219/328, 201, 331, 430, 219/437, 438, 439, 441, 462, 504, 505, 523, 530, 540, 541, 544, 552; 99/281; 338/22 R, 22 SD, 23; 552/520

[56] References Cited

U.S. PATENT DOCUMENTS

| | | | |
|---|---|---|---|
| 3,375,774 | 4/1968 | Fujimura et al. | 99/281 |
| 3,400,250 | 9/1968 | Buiting et al. | 219/441 |
| 3,719,796 | 3/1973 | Abildtrup | 219/462 |
| 3,725,643 | 4/1973 | Clausse | 219/441 |
| 3,835,434 | 9/1974 | Kahn | 338/22 R |
| 4,086,467 | 4/1978 | Grant | 219/544 |
| 4,104,509 | 8/1978 | Bokestal et al. | 219/544 |
| 4,147,927 | 4/1979 | Pirolti | 219/541 |
| 4,177,375 | 12/1979 | Meixner | 219/441 |

FOREIGN PATENT DOCUMENTS 1962119 10/1966 Fed. Rep. of Germany .

OTHER PUBLICATIONS

"Properties of Semiconductive Barium Titanates", by Osamu Saburi, *Journal of the Physical Society of Japan*, vol. 14, No. 9, Sep. 1959, pp. 1159-1174.

*Primary Examiner*—Volodymyr Y. Mayewsky
*Attorney, Agent, or Firm*—Hill, Van Santen, Steadman, Chiara & Simpson

[57] ABSTRACT

An immersion heater is disclosed having a heating member with a small thickness and comprised of PTC thermistor material. The heating member has the same heat contact between each of its two major surfaces and the medium to be heated. A Curie temperature $T_C$ and a specific resistance $\rho_{TC}$ of the material are dimensioned such that with a given operating voltage U a temperature regulation for the range with the positive temperature coefficient of the material results. By use of the upper limit of the Curie temperature $T_C$, extensive protection against fire can be obtained in the case of inappropriate handling of the immersion heater.

8 Claims, 3 Drawing Figures

IMMERSION HEATER

BACKGROUND OF THE INVENTION

The invention relates to an immersion heater having a housing which is inserted into liquid to be heated.

Immersion heaters for heating liquids, in particular water, have been known for a long time. The problem has existed to provide in every case a sufficient operating safety for such immersion heaters since the danger of fire with such apparatus is particularly great. Indeed, for an immersion heater the heating element can come directly in contact with materials such as a tablecloth, newspaper, etc. which are readily flammable. A protective screen for the heating element contained in the immersion heater, as has been readily employed in other kitchen appliances, cannot be practically realized for an immersion heater and could not normally be realized, at least up to now.

In conjunction with the protection of the heating resistor against overheating, the German Utility Model 1,962,119 has already suggested using a component known as a PTC thermistor as the heating resistor. A PTC thermistor is also referenced a ceramic PTC resistor. The PTC thermistor or resistor has a rapid resistance rise with a rising temperature within a relatively narrow temperature range. The location of the temperature range depends upon the material and depends upon the respective Curie-temperature of the material used for the PTC thermistor. The material per se is a ceramic material on the basis of barium titanate, whereby the position of the Curie temperature is determined, in particular, by the choice of a respective doping.

For the immersion heater with a PTC thermistor according to the above-captioned German utility model, however, no such useful technical disclosures are made which result in a functional device. To the contrary, disclosures, for example, for selection of the position of the temperature range for the resistance rise above mentioned are made which led one skilled in the art away from the inventive resolution described below.

SUMMARY OF THE INVENTION

It is an object of the present invention to disclose an immersion heater which has an operation-safe automatic overheating cut-off adjusted for a prescribed operating voltage.

This objective is inventively resolved with the aid of an immersion heater having a housing which is immersed into a liquid to be heated. The housing has mounted therein in insulated fashion a heating element comprising a PTC thermistor of ferroelectric ceramic material for automatic overheating cut-off. The heating element is formed as a flat member with a thickness of 0.5 to 2 mm and on whose major surfaces lying opposite one another current feed line electrodes are attached over large areas. The major surfaces of the flat member each have approximately the same heat contact with housing heating surfaces. The PTC thermistor material has a Curie temperature $T_C$ lying at least 50° K. above a given cut-off temperature $T_A$ and having a specific resistance of $\rho_{TC}=(U^2/0.08(T_C-T_A))$ with a tolerance width of approximately $0.5\cdot\rho_{TC}$ to $2\cdot\rho_{TC}$ with the Curie temperature and where U is a given operating voltage.

The invention is based upon the knowledge that for the previously known heating element, a safe cut-off effect can only be obtained with PTC thermistor material when the correct choice of the temperature range for the resistance re-rise i.e., the correct choice of the Curie temperature of the material was made, when additional relatively narrowly limited dimensions for the PTC thermistor material are adhered to, and when a correctly distributed heat removal for the member consisting of this PTC thermistor material is provided. Not only is the choice of the correct thickness dimensions of the plate or disk-shaped PTC thermistor element important but also the correct dimensioning of the specific resistance of the PTC thermistor material, which is determined by the equation $\rho_{TC}=(U^2/0.08(T_C-T_A))$. In this equation, U is the prescribed operating voltage. Not only the values 220 and 110 volt can be considered therefor, but also voltage values of 12 volts and 24 volts are of interest for the operation of the inventive immersion heater in passenger cars, travel trailers, travel buses, etc. Therefore it is required that the specific heat removal from the PTC thermistor member is to be made even across all major surfaces of this member. In contrast thereto, a maximum specific heat removal with an inhomogeneous distribution is of less importance.

A safe automatic cut-off is particularly important in vehicles, as there particularly little room is present for putting an immersion heater down without danger. The desired maximum temperature is to be employed for the cut-off temperature $T_A$, which, for example, practically amounts to 100° C. for the heating of water. The Curie temperature $T_C$, which is specifically determined with the PTC thermistor material selected, is to be at least 50° K. greater than the prescribed cut-off temperature $T_A$. However with regard to the danger of fire to be avoided, the Curie temperature $T_C$ is not to amount to more than approximately 250° C. Barium titanate, which has been known for a long time, can be considered as a PTC thermistor material, which is used for the selection of the Curie temperature $T_C$, and for the required specific resistance is doped in a manner known per se. A lead substitution, in particular, is suitable for a higher Curie temperature (see also Saburi, J. Phys. Soc. Jap., Vol. 14 (1959), Pages 1159–74).

The value of 0.08 of the previous equation for $\rho_{TC}$ takes into consideration a magnitude which is also very important for the invention, namely, the thermal resistance of the PTC thermistor material. As said resistance varies only within a tight range tolerable for the invention for PTC thermistor material in the framework of the inventively limited dimensioning of the invention, it is possible to prescribe this additional physical magnitude of the invention as a fixed number.

The heat output can be determined by the selection of the dimensions of the PTC thermistor member not yet set with respect to the thickness.

An immersion heater having dimensions selected according to the invention and $T_A=100°$ and $T_C$220° C., can be placed even on a highly flammable support even with an operating output of 500 watts for the heating of water, since its temperature, even with a complete localization of heat such as underneath a cover, cannot exceed a value of 300° C. The reason for this is the tightly dimensioned self-limitation of the temperature rise, which occurs in accordance with the PTC thermistor material used and inventively dimensioned. In addition, even with the malfunction of the self-limitation, a locally very narrowly limited burning-out of the material rapidly occurring in the PTC thermistor element would occur to which the electric fuse of the current supply circuit would respond with an immediate cut-off. With this burning-out of the PTC thermistor element, merely to be considered as the extreme case and as a double protection, currents occur which are greater than the operating currents by a factor of at least 10, which can thus be safeguarded as usual by simple safety fuses.

DESCRIPTION OF THE PREFERRED EMBODIMENTS

Figure 1:
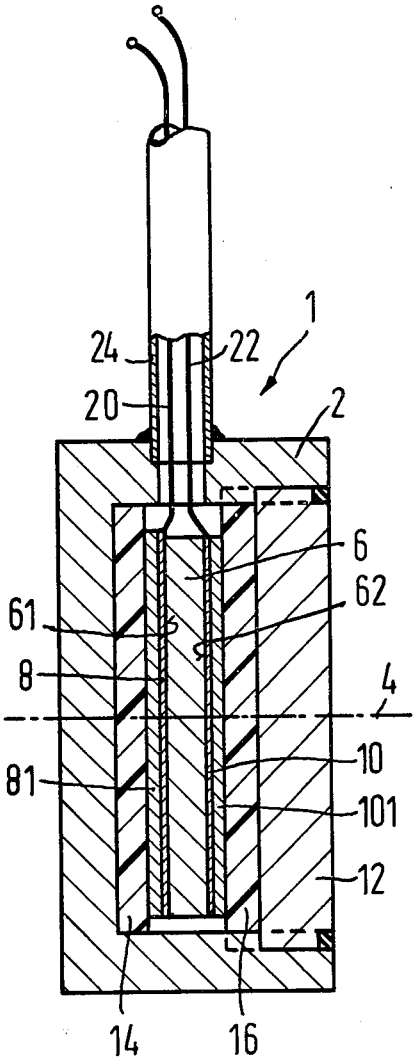
FIG. 1 illustrates a first embodiment of an inventive immersion heater.

The complete immersion heater of the invention is referenced 1. Its housing, for example, consisting of aluminum, has the reference symbol 2. The Figure illustrates this housing 2 in longitudinal section. If this housing 2 is advantageously circular, the axis, indicated by 4, lies in the illustration plane.

A thinly dimensioned disk according to the invention consisting of PTC thermistor material, is situated in the interior volume of housing 2 as seen in the Figure. This disk has metal electrodes 8, 10 on its large or major surfaces 61 and 62, standing vertically relative to the illustration plane of the Figure, said metal electrodes facilitating the feeding of current into the disk 6 over the entire surface.

The housing 2 is sealed in liquid-tight fashion with a cover 12, for example, by pressing-in said cover. An electric insulation consisting of aluminum oxide and designed in layer form is provided between the exterior surfaces of the electrodes 8 and 10 and the oppositely lying interior surfaces of housing 2 and cover 12 in the embodiment illustrated in the Figure. These insulation layers are referenced 14, 16.

A film or foil 81 or 101 consisting of lead is advantageously inserted between the respective electrode 8 or 10 and the respective insulation layer 14, 16, as is obvious from the Figure. This lead film has a ductile property which is important as a cushion so as to provide a certain elasticity between the disk 6 consisting of PTC thermistor material and the relatively hard materials (in comparison to lead) of the housing 2, the cover 12 and the insulation layers 14, 16.

Feed lines referenced 20 and 22 extend from the electrodes 8, 10 and are directed towards the exterior through a tube-shaped extension 24 of housing 2. The provided operating voltage can be connected to these feed lines 20, 22.

Figure 2:
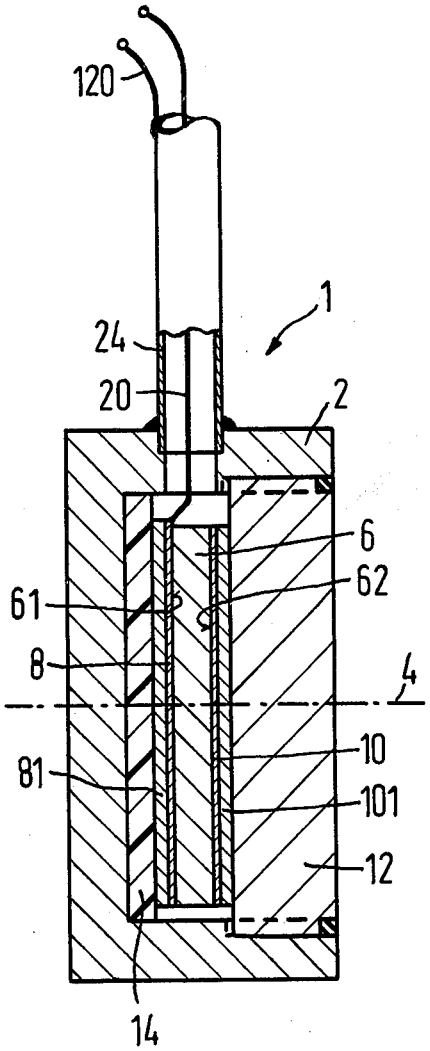
FIG. 2 shows an additional embodiment.

For an immersion heater to be operated with low voltages such as 12 volts or 24 volts, the current feeding to one of the two electrodes 8, 10 can also proceed via the housing per se. For this purpose, the insulating layer 14 or the insulating layer 16 need only be omitted on one of the two sides, so that there either the housing 2 or the cover 12 directly abut the lead film 81 or 101 with an electric contact. FIG. 2 shows an embodiment in which the same reference symbols were used as in FIG. 1. The connection mounted to the housing is referenced 120.

For an inventive immersion heater it is important that not only the best possible but also the most even heat contact from the two large major surfaces 61, 62 of disk 6 into the housing 2 or into the cover 12 is present. Also the exterior sides of housing 2 and cover 12 should have the same efficient heat contact with the liquid to be heated. Due to the efficient heat conducting property of the aluminum oxide and the fact that the thickness of this layer is dimensioned small, the difference of construction present for the two sides of disk 6 is not yet important for the previously mentioned embodiment of the invention employed with low voltage.

Figure 3:
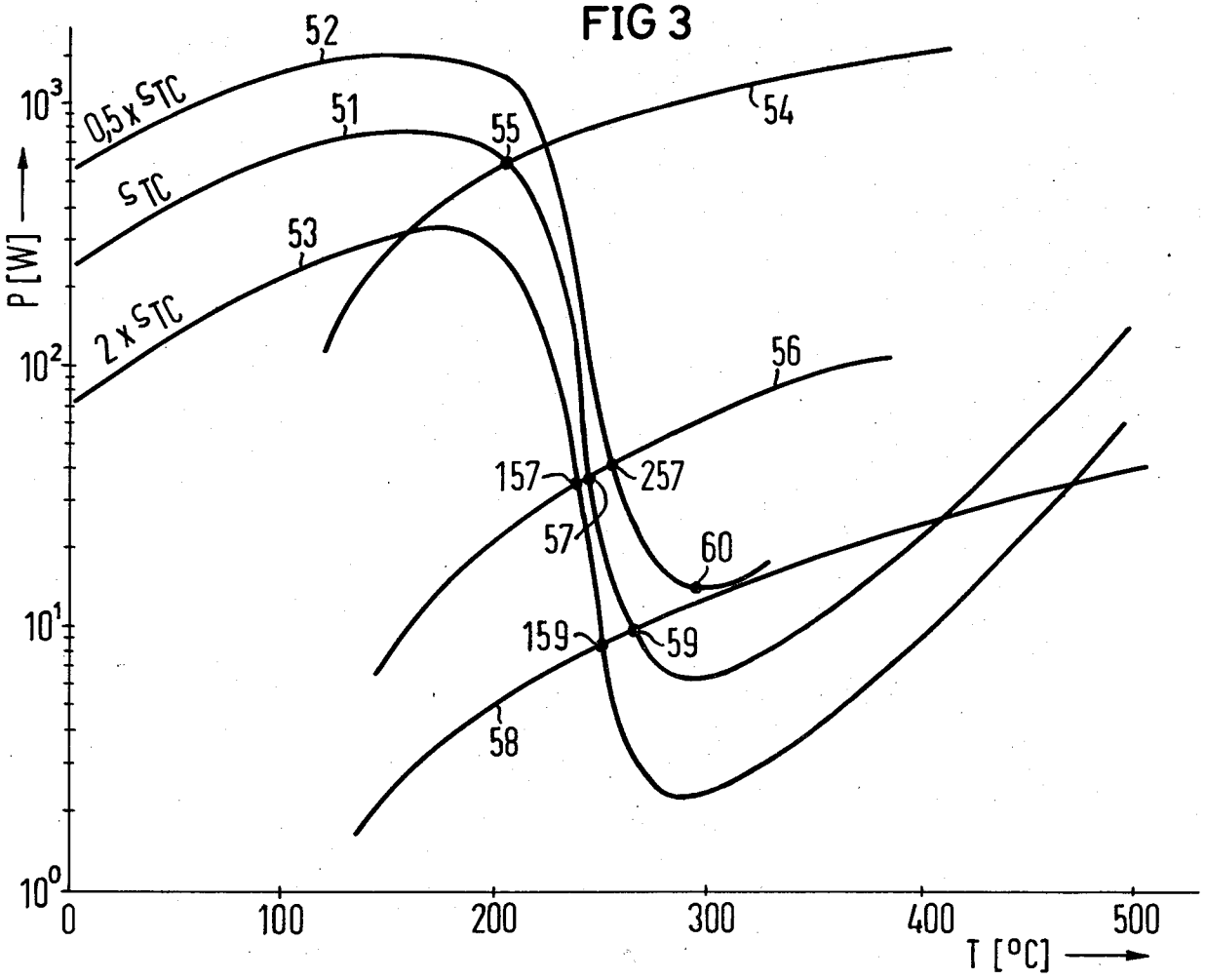
FIG. 3 illustrates a diagram concerning temperature behavior.

FIG. 3 illustrates a diagram from which the behavior of an inventive immersion heater can be concluded. The diagram explains the heater's behavior when the immersion heater in a switched-on condition is no longer situated in liquid. Such a case, as already mentioned above, occurs when an inventive immersion heater in switched-on condition is accidentally placed on a relatively readily combustible support, perhaps even where heat localization occurs in a covered condition.

In FIG. 3, the temperature is plotted on the abscissa and the heat output values are plotted on the ordinate. Curves for the amount of heat production of an inventive immersion heater are referenced 51, 52 and 53. Specifically, curve 51 is an immersion heater having a specific resistance $\rho_{TC}$ and precisely designed in accordance with the invention. Curve 52 represents a smaller resistance of $0.5 \cdot \rho_{TC}$. Curve 53 represents a specific resistance value greater by $2 \cdot \rho_{TC}$. The PTC thermistor material has a Curie temperature of 220° C. These three curves 51, 52 and 53 illustrate the tolerance range taken into consideration in accordance with the invention. These curves are considered for the electric output produced in the PTC thermistor material. 54 characterizes a curve illustrating the heat output at boiling temperature of an inventive immersion heater designed in accordance with the sample embodiments. Accordingly, the curve 54 holds true for the three curves 51 through 53. 55 references the intersection between curve 51 and curve 54. The temperature value belonging to point 55 is the maximum temperature the immersion heater can have when immersed into the boiling liquid.

56 references a curve corresponding with curve 54 valid for the immersion heater if it is situated in air outside of liquid. This, for example, would be the case when the liquid is completely evaporated in the receptacle. 57 characterizes the temperature value corresponding with 55 to which the immersion heater is now heated to a maximum. Due to the steep drop of curves 51, 52 and 53 in the range critical for this condition alteration (the position of this range is provided on the basis of the inventive resistance dimensioning) the temperature rise from point 55 to point 57 is relatively small.

58 characterizes an additional curve corresponding with curves 54 and 56, valid for the case where a localization of heat occurs, i.e., if the inventive immersion heater in switched-on condition is covered up. Point 59 again is the maximally obtainable temperature value. This temperature value also does not lie very far above the temperature value of point 55 provided for the normal, defined operation.

157 and 257 are points for maximum temperatures belonging to point 57, which are obtained with either a correspondingly greater or smaller specific resistance value.

Point 159 is the maximum temperature value corresponding with point 59. For a specific resistance value which is 0.5 times lower than the inventively disclosed theoretical value, no intersection of the curve 52 with curve 58 results in this illustration. In case of this specific dimensioning, i.e., in this specific position of the curves 52 and 58 relative to one another, the following results: an inventive immersion heater dimensioned with ($0.5 \cdot \rho_{TC}$) with a localization of heat is first heated to a temperature value which corresponds with point 60 representing the minimum of curve 52. From this point on, the output production of the immersion heater rises again due to a great conductivity rise based upon a negative temperature characteristic. This corresponds with the second safety feature of the inventive immersion heater already explained above. From point 60 on, however, a temperature increase in the PTC thermistor material proceeding within msec results, which leads to the immediate burning-out of the immersion heater, described above, with a switching-off of the conventional circuit fuse. This extremely rapidly proceeding final condition is characterized by the breaking-off of the curve 52 in the illustration of FIG. 3. The respective temperature values for this range between point 60 and the end of curve 52 are determined in impulse operation. In normal operation, this temperature increase cannot even be determined, as this increased heat production does not penetrate the surface, i.e., towards the exterior, due to the short length of time.

Depending upon the requirements, as is obvious from FIG. 3, an inventive immersion heater can be dimensioned such that it even survives without damage an operation with an unintended localization of heat, or that the inventive immersion heater burns through as a result of a localization of heat, for example, by careless placing underneath a cover, so that even for the extreme case, such as a relatively easy combustibility of the surrounding material, safety from fire is guaranteed.

Practical experiments were made with an inventive immersion heater with $T_C=220°$ C. and with a heat output of 500 watts (in the range through the boiling temperature of 100° C.). Such an immersion heater under operating voltage was placed on a thicker support consisting of paper and additionally covered with a dishtowel consisting of cotton. After a considerable switch-on time only a brown coloration of paper and cloth resulted. This experiment acknowledges the obtained measure of relative safety from fire with an accidental inappropriate handling. Naturally, an inventive immersion heater is to be cut off from the operating voltage when inappropriately used.

For the electrodes 8 and 10, for example, aluminum is suitable. A thin layer of silver can also be used, whose blocking layer effect, known per se, becomes ineffective on such a PTC thermistor material with the electric operating voltages considered.

For the selection of the output value of an inventive immersion heater, the surface dimensioning (of the surfaces 60 or 61) is a matter of choice. For a 500 watt output of the above described unit, the surface 60 has a magnitude of approximately 800 $mm^2$ at a thickness of 1.5 mm.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A liquid immersion high output heater, comprising: a sealed metal housing means having heat conductive walls for immersion into a liquid to be heated; said housing means having mounted therein an electric heating element provided with current feed lines; an insulation means insulating at least one of the feed lines and a portion of the heating element from the housing means; the heating element being a positive temperature coefficient (PTC) thermistor means comprising ferroelectric ceramic material for automatic overheating cutoff; said heating element being formed as a thin 0.5 to 2 mm thick flat disc-like member on whose two major surfaces lying opposite one another the current feed lines are attached by metal electrodes over the entire respective major surfaces of the heating element; the major surfaces of the heating element each having a same heat contact with said housing heating surfaces; and the PTC thermistor means material having a Curie temperature $T_C$ lying at least 50° K. above a given desired cutoff temperature $T_A$, and having a specific resistance at the Curie temperature $T_C$ of $$\rho_{TC}=(U^2/0.08(T_C-T_A)$$

with a tolerance width of approximately $0.5 \cdot \rho_{TC}$ to $2 \cdot \rho_{TC}$ where U is a given operating voltage, whereby a high power output immersion heater of greatly improved reliability is provided.

2. The heater of claim 1 wherein the Curie temperature $T_C$ of the PTC thermistor means material is less than approximately 250°.

3. The heater of claim 1 wherein said operating voltage is approximately 12 volts and a specific resistance $\rho_{TC}$ of the PTC thermistor means material is between 10 and 50 ohm·cm.

4. The heater according to claim 1 where said operating voltage is 24 volts and said specific resistance $\rho_{TC}$ of the PTC thermistor means material is between 30 and 150 ohm·cm.

5. A heater according to claim 1 wherein the heater is capable of a heat output of 500 watts when heating a liquid.

6. A heater according to claim 1 wherein each of heating element major surfaces has an area of approximately 800 $mm^2$.

7. A liquid immersion high power output heater, comprising: a sealed housing means for immersion into a liquid to be heated and having heat conductive walls forming first and second major heating surfaces; a flat disc-like heating element mounted in the housing means and comprising a positive temperature coefficient (PTC) thermistor means of ferroelectric ceramic material for automatic heating cutoff; said PTC thermistor means having a Curie temperature $T_C$ lying at least 50° K. above a given cutoff temperature $T_A$ and having a specific resistance at the Curie temperature $T_C$ $$T_C=(U^2/0.8(T_C-T_A))$$

with a tolerance of approximately $0.5 \cdot \rho_{TC}$ to $2 \cdot \rho_{TC}$ where U is a given operating voltage; and said heating element having first and second parallel major surfaces spaced 0.5 to 2 mm apart, a metal contact covering each major surface and a connection lead to each metal contact, and a heat contact between the first major surface and the housing means first major heating surface being the same as a heat contact between the second major surface and the housing means second major heating surface such that each of the first and second major surfaces of the heating element are in the same heat contact with the liquid medium to be heated.

8. A heater according to claim 7 wherein the heater is capable of a heat output of 500 watts when heating a liquid.

* * * * *